US005299339A

United States Patent [19]

Georgantas

[11] Patent Number: 5,299,339

[45] Date of Patent: Apr. 5, 1994

[54] JET DYEING APPARATUS AND METHOD

[75] Inventor: Aristides Georgantas, Athens, Greece

[73] Assignee: S. Sclayos S.A., Athens, Greece

[21] Appl. No.: 793,403

[22] PCT Filed: May 11, 1991

[86] PCT No.: PCT/EP91/00896

§ 371 Date: Feb. 13, 1992

§ 102(e) Date: Feb. 13, 1992

[87] PCT Pub. No.: WO91/18141

PCT Pub. Date: Nov. 28, 1991

[51] Int. Cl.[5] ..... D06B 3/28

[52] U.S. Cl. ..... 8/152; 68/177; 68/178

[58] Field of Search ..... 68/177, 178, 180, 175, 68/176; 8/151, 152

[56] References Cited

U.S. PATENT DOCUMENTS

| | | | |
|---|---|---|---|
| 1,041,031 | 10/1912 | Craig | 68/178 |
| 1,074,567 | 9/1913 | Gantt | 68/178 |
| 1,655,624 | 4/1928 | Conrad . | |
| 2,228,050 | 1/1941 | Collier | 68/177 |
| 2,403,311 | 7/1946 | Steele | 28/1 |
| 2,579,563 | 12/1951 | Gallinger | 68/5 |
| 3,587,256 | 6/1971 | Spara | 68/177 |
| 3,802,840 | 4/1974 | Chiba et al. | 8/152 |
| 3,949,575 | 4/1976 | Turner et al. | 68/5 |
| 3,982,411 | 9/1976 | Kreitz | 68/177 |
| 4,023,385 | 5/1977 | Hurd | 68/62 |
| 4,041,559 | 8/1977 | von der Eltz | 8/49 |
| 4,142,385 | 3/1979 | Sandberg et al. | 68/178 |
| 4,318,286 | 3/1982 | Sturkey | 68/178 |
| 4,716,744 | 1/1988 | Turner et al. . | |
| 4,766,743 | 8/1988 | Biancalani et al. | 68/20 |
| 4,803,208 | 4/1978 | Ekstroem | 68/181 |

FOREIGN PATENT DOCUMENTS

| | | | |
|---|---|---|---|
| 2140788 | 2/1973 | Fed. Rep. of Germany . | |
| 2292410 | 6/1976 | France | 68/177 |
| 2315564 | 1/1977 | France . | |
| 60-9150 | 3/1985 | Japan | 68/177 |
| 2-14065 | 1/1990 | Japan | 68/177 |
| 2004927 | 9/1977 | United Kingdom . | |
| 2031969 | 10/1978 | United Kingdom . | |

*Primary Examiner*—Frankie L. Stinson

*Attorney, Agent, or Firm*—Bell, Seltzer, Park & Gibson

[57] ABSTRACT

An improved jet dyeing apparatus is provided which enables the user to dye either lightweight or relatively heavy weight fabrics (1) in the same apparatus with improved efficiency and product quality. The apparatus includes a unique fabric plaiting mechanism (7) which is mounted to the exit end of a transport tube (11) for relative rotation about the transport tube (11) whereby a downwardly directed outlet nozzle (15) defined by the plaiting mechanism (7) reciprocates along a generally linear path of travel transverse to the transport tube (11) and such that the fabric (1) passing through the transport tube (11) will be deposited in a liquid treatment chamber (10) in overlying relatively straight folds in order to maximize capacity in the dyeing apparatus and to improve the stability of the fabric being treated therein. Furthermore, in accordance with an additional aspect of the invention, higher capacities may be achieved through use of a transport tube (11) which utilizes a plurality of liquor sprayer systems (3, 4) and which is preferably v-shaped in profile so that a first transport zone is provided which is preferably downwardly inclined at a mild angle and a second transport zone is defined which is generally upwardly inclined with the plaiting nozzle. The invention also includes the related method of dyeing a textile material.

9 Claims, 3 Drawing Sheets

JET DYEING APPARATUS AND METHOD

This invention relates to a jet dyeing apparatus for dyeing textile materials which is particularly desirable for use in dyeing textile fabrics in rope form. In apparatuses of this type, the fabric to be treated is continuously circulated through a treatment zone or transport tube in which dye liquor is applied to the fabric under pressure. The pressurized liquor serves a dual function, namely to dye the fabric as well as to impart movement to the fabric rope which is conveyed from the transport tube into a fabric storage chamber. Within the storage chamber, the fabric is submerged in excess dye liquor and moves through this chamber suspended in the liquor until it is removed from the opposite end for conveyance through the transport tube whereupon the cycle is repeated.

As noted, pressurized dye liquor is applied to the fabric in the fabric transport tube. For this purpose, the tube typically includes at least one peripheral liquor sprayer or "P.L.S." which is designed to apply the liquor under pressure to the fabric about its complete circumference. It is particularly desirable to apply the pressurized liquor in a way which enhances the interchange between the dyestuffs and the fabric in order to enhance the uniformity of the dye application to the fabric. In order to dye the fabric successfully, however, it is also necessary that the fabric travel at relatively high speeds through the transport tube, but while still ensuring that the desired level of liquor-fabric interchange occurs.

In order to increase operating speeds, it is customary to utilize relatively high liquor pressures in the peripheral liquor sprayer, for example, in order to enhance fabric throughput and fabric-liquor interchange. Unfortunately, the use of high water pressures often results in damage to the surface of the fabric (i.e., peeling or pitting) and "stitch" deformation. The problem is particularly acute with lightweight fabrics which are more susceptible to damage from the relatively high pressures which means that the fabric finisher must typically either reduce his operating rates or compromise the quality of the resulting dyed products.

Representative jet dyeing machines for dyeing fabrics in continuous rope form are shown, for example, in U.S. Pat. Nos. 3,587,256 (Spara), 3,949,575 (Turner, et al.), 3,982,411 (Kreitz), 4,083,208 (Ekstroem), and 4,318,286 (Sturkey). The art-recognized problems of surface degradation in dye treatments, and with lightweight fabrics in particular, are described in Kreitz and Sturkey. For his part, Kreitz suggests that a plurality of nozzles be utilized of differing construction depending upon the type of fabric to be treated in the jet dyeing apparatus. This increases downtime since the apparatus must be modified each time the weight of the fabric to be treated in the jet dyeing apparatus is changed materially. As an alternative, Sturkey proposes the use of a modified j-box and an elongate liquor transport tube which has a steep upward incline in order to ensure, according to Sturkey, that the treated fabric will be conveyed through the transport tube with relatively reduced surface degradation. The problem in the Sturkey device, however, is that the use of a single liquor sprayer at the inlet in combination with the elongate tube, means that extremely high pressures must be used in order to maintain any reasonable throughput through the jet dyeing machine.

A still further modified jet dyeing apparatus is described in U.S. Pat. No. 4,083,208 to Ekstroem which also recognizes the problem presented by the desire to use the same jet dyeing apparatus for the purpose of dyeing either lightweight or heavier fabrics as well as yarns. Ekstroem suggests the use of a discharge pipe of varying undulated constructions which also requires changes in piping construction depending upon the weight of the fabric to be treated. Furthermore, Ekstroem advocates the use of a perforated region in the undulated pipe for the purpose of reducing the rate of travel in the fabric, ostensibly for the reason of reducing turbulence at the discharge point, but with the result that substantial liquor will be drained from the fabric while it is still in the transport chamber, and with the additional result that the capacity of the apparatus will be unduly restricted.

Additional fabric transporting arrangements are shown in U.S. Pat. Nos. 1,665,624 (Conrad), 2,228,050 (Collier), 2,403,311 (Steele), 3,802,840 (Chiba, et al.), 4,041,559 (Von Der Eltz), 4,142,385 (Sandberg, et al.), 4,766,743 (Biancalani, et al.), and in United Kingdom patent application 2,031,969, French publication no. 2,315,564, and German Offenlegungschrifft 2,140,788 which depicts an apparatus for loading and unloading textile material to be wet treated.

Even where higher throughput rates in the fabric transport tube are achieved, related problems can arise which limit the effective capacity of the jet dyeing apparatus. Specifically, it is customary in dyeing fabrics that the fabric leaving the fabric transport tube is delivered into the storage chamber, which is otherwise referred to as the "j-box" or keir. The apparatus which controls the placement of the fabric within the storage chamber or j-box is typically referred to as the "plaiter". It is customary in plaiting the fabrics to induce the formation of longitudinal folds in the fabric as shown, for example, in U.S. Pat. Nos. 4,318,286 (Sturkey) and in 4,023,385 (Hurd), the latter of which describes an oscillating valve for inducing formation of the folds through the use of air pressure. These arrangements can create problems in the form of entanglement of the fabric in the chamber and are inefficient because the capacity in the storage chamber is under-utilized.

Alternative arrangements for plaiting fabrics in a jet dyeing machine are shown in U.S. Pat. No. 2,579,563 to Gallinger and in United Kingdom patent application 2,004,927 ("Mezzera"). In accordance with the disclosures in these additional references, a plaiting nozzle is oscillated transverse to the direction of travel of the fabric through the fabric transport tube and is also preferably oscillated in a longitudinal direction (using the hood 21 in Mezzera, for example) or by axial movements of the discharge nozzle in accordance with the embodiment shown in FIG. 4 of Mezzera. The transverse and longitudinal action results in a parallelipiped arrangement of the fabric which is said to improve the stability of the stored fabric in the j-box in order to attempt to minimize occurrences of fabric entanglement within the j-box or storage chamber.

As an alternative to the simultaneous plaiting of the fabric in both the longitudinal and transverse orientations, it is also known in the art that the entire fabric transport tube, including a fixed plaiting nozzle, may be oscillated in a direction transverse to the main path of travel of the fabric. While this approach forms generally transverse folds in the fabric, it substantially limits the production capacity of the apparatus and increases wear and tear on the entire assembly. Furthermore, the fabric is deposited in the fabric storage chamber in a generally arcuate pattern which is inherently unstable and which wastes the available capacity in the fabric storage chamber.

A similar problem of the instability of the fabric leading to entanglement also arises from the use of a fabric discharge nozzle of the orientation shown in the Mezzera United Kingdom reference described above since the angle of the discharge nozzle is disposed outwardly in a manner which will inherently deposit the fabric in a generally arcuate pattern as it is placed in the j-box. This stack is inherently unstable and wastes capacity within the storage chamber. Here again, the most significant problems are presented by lightweight fabrics and, as noted above, it is particularly desirable to provide a jet dyeing apparatus which is effective for dyeing both lightweight as well as heavier weight fabrics while maximizing the overall capacity of the apparatus.

In accordance with the present invention, the desired object of maximizing capacity while minimizing tension and creasing of the fabric in the "J"-box leading to entanglements is achieved by providing a jet dyeing apparatus which includes a housing having a liquid treatment chamber positioned in the lower portion of the housing which has an upwardly open inlet and an upwardly open outlet. The apparatus also includes a fabric transport tube in the housing positioned above the liquid treatment chamber which comprises an elongate tubular member which defines a generally horizontal centerline which has an exit end for mounting a plaiting apparatus. A plaiting apparatus is also provided in accordance with this aspect of the invention, which member is mounted to the exit end of the transport tube for relative rotation about its centerline and which includes a downwardly directed outlet nozzle which overlies the inlet to the liquid treatment chamber. Finally, means for oscillating the plaiting member about the centerline are provided such that the downwardly directed nozzle reciprocates along a generally linear path of travel which is transverse to the centerline of the transport tube such that fabric passing through the tube is deposited in overlying relatively straight folds in the chamber to maximize capacity and improve the stability of the fabric entering the storage chamber.

Also in accordance with a particularly preferred aspect of the present invention, increased capacity may be attained through the use of a fabric transport tube which includes a plurality of peripheral liquor sprayer systems or other jets which are fed with dyeing liquor from a common supply. In this fashion as described herein, the highest fabric speeds may be achieved at the lowest possible water pressure. In accordance with this aspect of the invention, the first peripheral liquor sprayer is preferably placed at the entry end of the fabric transport tube, i.e. the fabric inlet to the fabric transport tube, while a second peripheral liquor sprayer is preferably positioned just beyond the midpoint of the fabric transport tube. In addition, the section of the fabric transport tube between the first peripheral liquor sprayer and the approximate midpoint of the transport tube defines a first transport zone which is preferably downwardly inclined at a mild angle while the section of the fabric transport tube after the midpoint and containing the second peripheral liquor sprayer, is generally upwardly inclined toward the plaiting nozzle to define a second transport zone.

The use of a plurality of liquor sprayer systems in accordance with the invention will correspondingly increase the volume of liquor which is applied to the fabric in the fabric transport tube to enhance the liquor-fabric interchange within the transport tube. In this fashion, the attainment of relatively higher throughput rates may be accomplished despite the fact that relatively lower output pressures may be utilized at each of the peripheral liquor sprayers, respectively, to improve the quality of the dyed products.

As noted, the use of a plurality of peripheral liquor sprayers will increase the overall volume of liquor traveling through the fabric transport tube with the further result that greater volumes of excess liquor will be deposited by the outlet nozzle of the plaiter onto the orderly fabric pleats previously formed by the plaiting mechanism. In order to avoid disruption of the orderly pattern of the fabric pleats which have been formed previously in the j-box, the invention may additionally include an excess liquor bypass which may be desirably formed integrally with the outlet nozzle of the plaiting mechanism. The excess liquor bypass is formed on the outer curve of the elbow defining the outlet nozzle and adjacent the defined path of travel for the fabric. In view of the pressures which are preferably employed in operation, the excess liquor will travel through a perforated plate in the outlet nozzle so that the liquor is diverted outside the main area of the liquid treatment chamber so that a relatively small percentage of dye liquor entering the liquid treatment chamber falls directly on the fabric which has been plaited. The excess liquor may then travel through a distinct path of travel and may be in fluid communicating relation to the chamber through perforations or the like so that the liquor may then be recirculated to the header associated with the peripheral liquor sprayers.

The unique plaiting system as described herein deposits the fabric in the storage chamber in an orderly manner so that the full width of the chamber is utilized and so that each new plait of fabric is deposited in overlying relatively straight folds square to the centerline of the storage chamber. In this manner, the fabric remains relatively undisturbed until it reaches the front exit of the storage chamber and helps to ensure that entanglement of the stored fabric as it moves through the storage chamber will be minimized or avoided completely. In addition, the use of a plurality of liquor sprayers as described in conjunction with the preferred transport tube enables the attainment of relatively higher operating speeds while minimizing the likelihood of fabric degradation in the process.

This invention also relates to the method of dyeing a length of textile material as described herein which includes the steps of guiding a length of textile material through a generally horizontally directed transport tube while applying a jet of liquid dye onto the material in the tube to dye the fabric and advance it through the transport tube. The textile material is then advanced downwardly from the exit end of the transport tube and reciprocated along a linear path of travel transverse to the direction of advance through the transport tube so as to form overlying relatively straight folds of the material in the transport chamber.

Additional features of the invention will be described hereinbelow in conjunction with the accompanying drawings in which.

Figure 1:
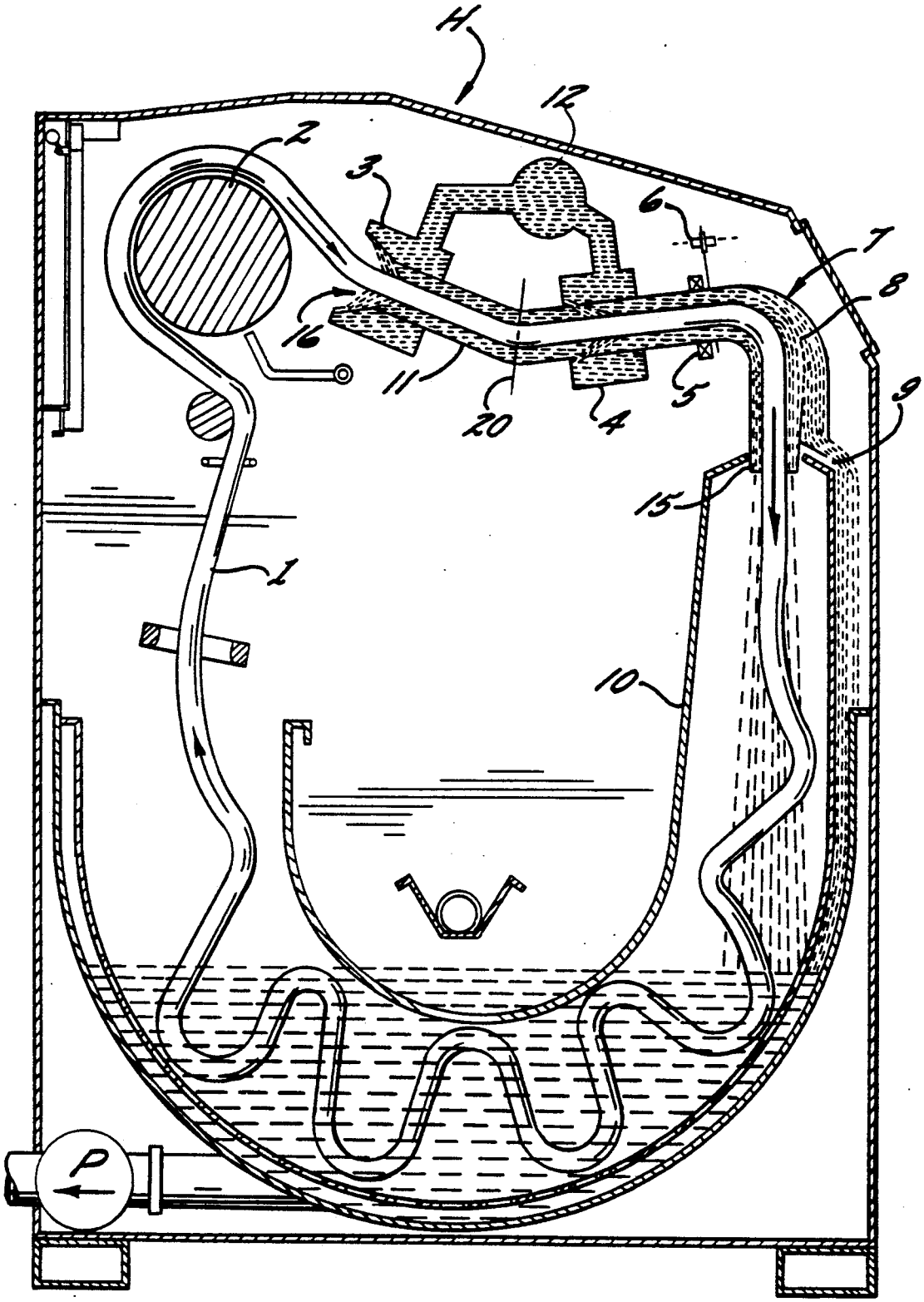
FIG. 1 is a side schematic view showing the general arrangement of the fabric transport tube and particularly in relation to the j-box or liquid treatment chamber.
Figure 2:
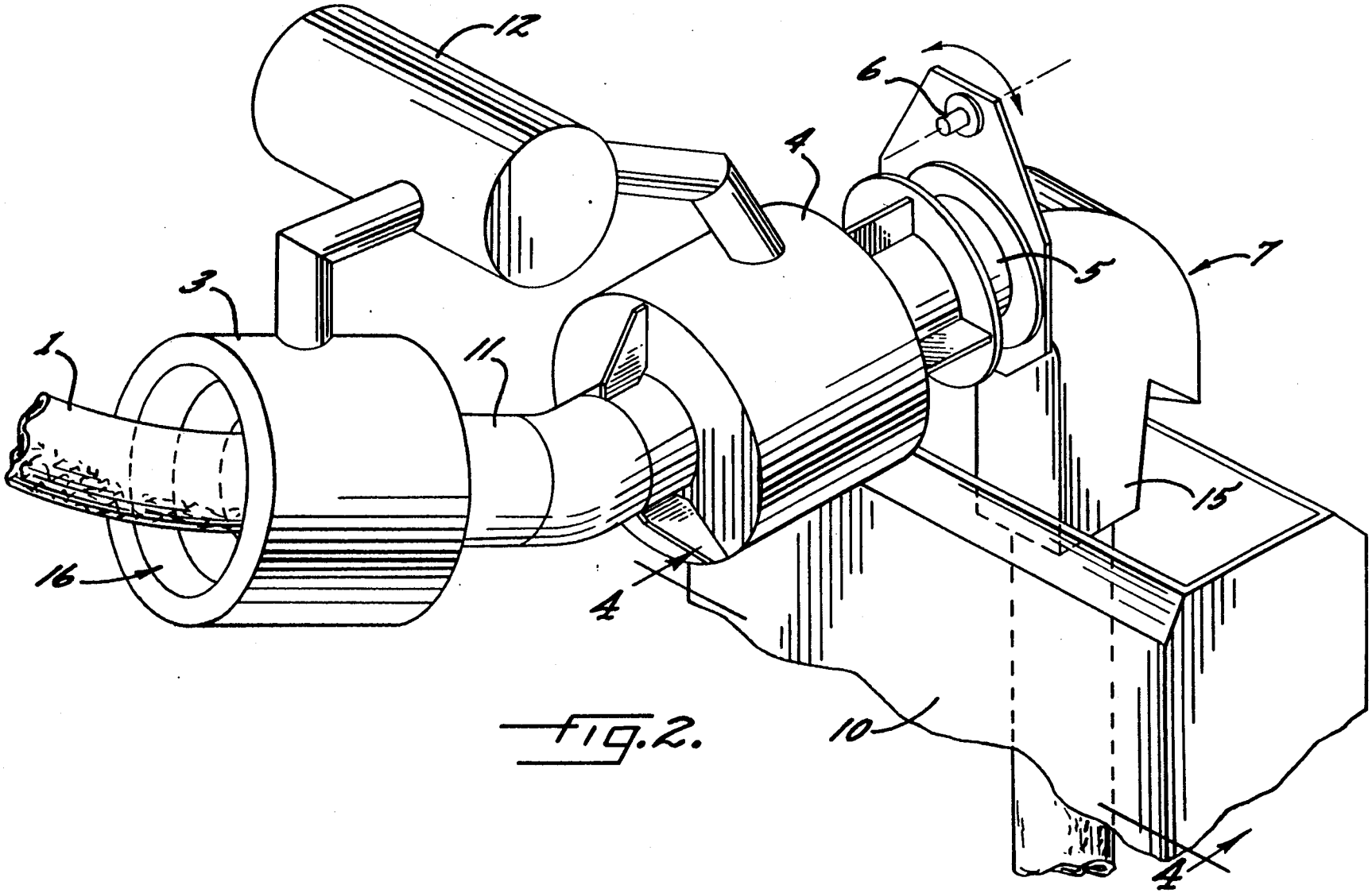
FIG. 2 is a side perspective view which particularly depicts the fabric transport tube and the plaiting mechanism made in accordance with this invention to deposit the fabric in an orderly way within the liquid treatment chamber and also depicting the preferred rectangular design of the outlet nozzle.

As shown in schematic form in FIG. 1 the jet dyeing apparatus comprises a housing H which includes a liquid treatment chamber or j-box 10 in the lower portion of the housing and a fabric transport tube 11 in the housing above the liquid treatment chamber. In use, the fabric 1 enters the fabric transport tube 11 with the assistance of a driven rotating cylinder 2 as is customary in jet dyeing apparatuses of this general type.

The fabric enters the fabric transport tube 11 at a fabric inlet or entry end 16 and is immediately contacted with liquor from a jet apparatus or peripheral liquor sprayer 3 which is supplied with liquor from a common supply or header 12. The preferred peripheral liquor sprayer sprays liquor on the fabric in a manner which both dyes the fabric and which also serves to transport the fabric 1, which is typically in continuous rope form, along the longitudinal direction of the fabric transport tube 11 and ultimately to the plaiter mechanism 7.

In accordance with the present invention, the fabric transport tube 11 preferably includes a plurality of peripheral liquor sprayers including the first aforementioned sprayer 3 at the inlet or entry end 16 to the fabric transport tube 11 and a second peripheral liquor sprayer 4. The two peripheral sprayers are preferably supplied by a common header 12. In accordance with the preferred arrangement shown in FIG. 3, the second peripheral liquor sprayer 4 is preferably positioned downstream of the first peripheral liquor sprayer 3 and closely adjacent the midpoint 20 of the fabric transport tube 11. As shown, the nozzle of the second peripheral liquor sprayer 4 is spaced approximately 135 mm from the approximate midpoint 20.

Figures 3, 4:
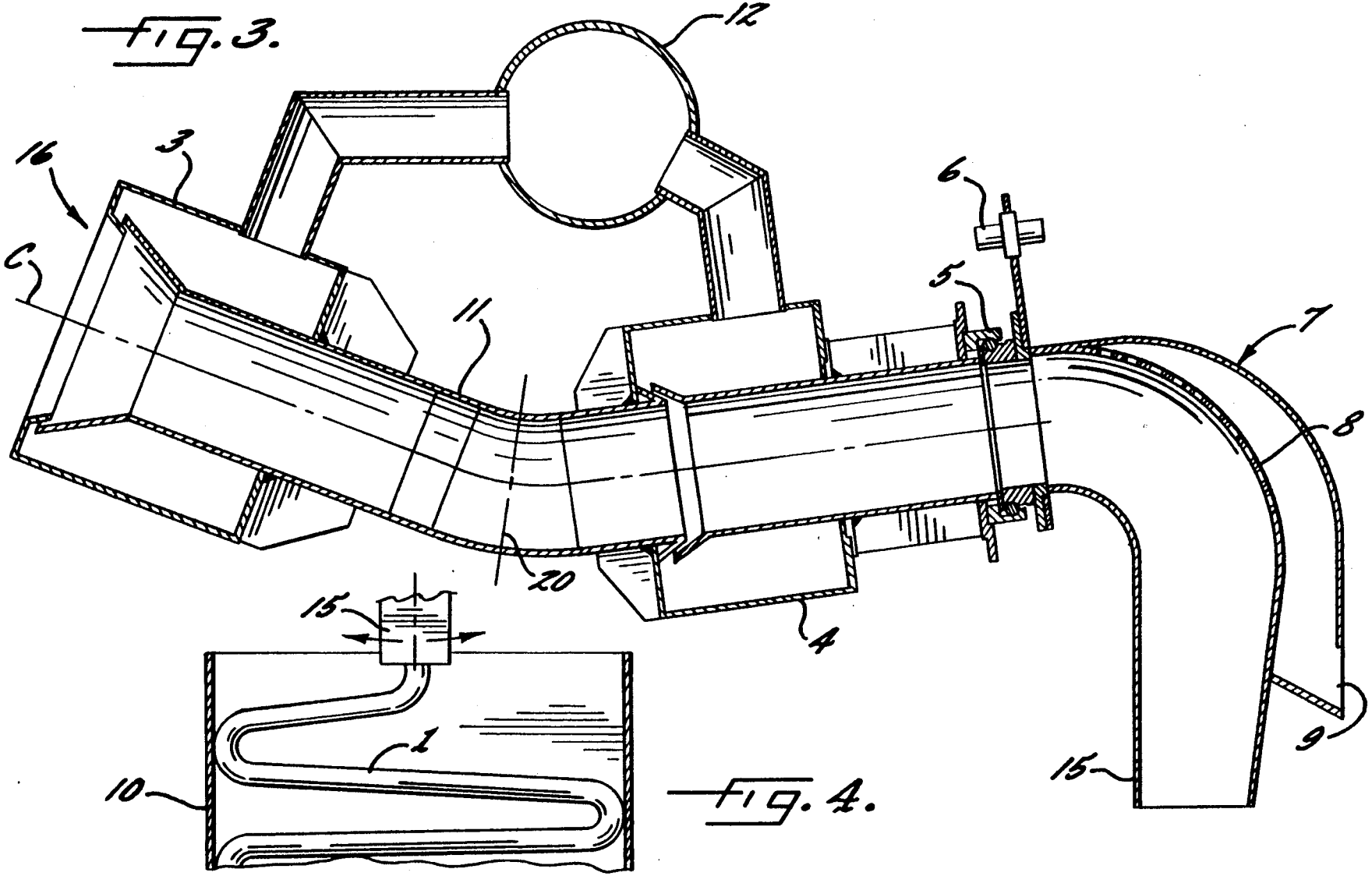
FIG. 3 is a detailed side elevation view depicting the fabric transport tube and the plaiting mechanism including the outlet nozzle in detail in accordance with the present invention.
FIG. 4 is a front schematic taken substantially along the line 4—4 in FIG. 2 and depicting the general pattern of deposition of the fabric in accordance with the invention.

In accordance with one aspect of this invention, and as shown particularly in FIG. 3, the fabric transport tube 11 defines a generally horizontal centerline C (FIG. 3). In addition, the transport tube 11 is preferably downwardly inclined in the region between the entry to the fabric transport tube 16 at the first peripheral liquor sprayer 3 and then upwardly inclined beginning near the midpoint of the fabric transport tube 20. In this manner, a first transport zone is defined commencing at the fabric inlet to the fabric transport tube 16 where the first peripheral liquor sprayer 3 is positioned, and then extending at a generally downward mild incline to the approximate midpoint 20 of the fabric transport tube 11 whereupon a second transport zone intersects the first transport zone at the lowermost point in the fabric transport tube and then extends at a gentle slope upwardly at an incline to the outlet of the fabric transport tube defined by the means mounting the plaiter mechanism 5.

In accordance with the preferred embodiment, the fabric transport tube will have a shallow v-shaped outline in profile. In this manner, the fabric transport tube 11 will be flooded with dye liquor to improve the liquor fabric interchange within the fabric transport tube, but without significantly impeding the progress of the fabric through the transport tube. In addition, this design creates a slight turbulence which tends to rearrange the fabric folds leaving the first transport zone prior to treatment in the second peripheral liquor sprayer 4.

The effective pressures at the nozzles of the peripheral liquor sprayers 3 and 4 may be varied in accordance with the invention, but will typically range from 0.1 to 0.5 bar which will correspondingly affect the speed of travel for the fabric 1 through the fabric transport tube 11. For example, in the arrangement as particularly depicted in detail in FIG. 3, the rate of travel for the fabric attainable with this arrangement is approximately 110 meters per minute at 0.10 bar inlet pressure and rises to a rate of approximate 240 meters per minute at a corresponding water pressure of 0.40 bar at the peripheral liquor sprayers 3 and 4. The angle defined by the interior diameter of the fabric transport tube and the sidewall of the nozzle within the peripheral liquor sprayer may also be varied but as shown is approximately 30 degrees.

The included angle defined between the two sections of the fabric transport tube at the midpoint 20 also may be varied in accordance with the invention, but will preferably fall in the range from about 110 to about 180 degrees and preferably in the range from about 130 to 160 degrees to define the slight "v" shape in profile. As shown in FIG. 3, the particular preferred arrangement defines an included angle of about 150 degrees at the midpoint 20 which is the junction between the first transport section and the second transport section.

The overall length of the fabric transport tube 11 also may be varied in accordance with the present invention as may be the approximate length of the first and second transport zones defined by the fabric transport tube. For example the length of the first transport zone which is defined by the distance from the entry point 16 to the fabric transport tube 11 to the approximate midpoint 20 may vary in the range from 200 to 800 millimeters and is approximately 500 millimeters in the particular arrangement as depicted in the drawings. The length of the second transport zone also may be varied over similar ranges and is preferably approximately the same length as the first section and at approximately the same positive angle corresponding to the negative angle applied in the first transport zone, so that the outlet of the fabric transport tube at the plaiting mechanism 7 at the bearing 5 will lie at approximately the same elevation as the entry point 16 at the first peripheral liquor sprayer 3.

In accordance with the present invention, a unique plaiting mechanism 7 is provided. The curved plaiter 7 directs the fabric vertically downwardly into the liquid treatment chamber or storage chamber 10 (FIG. 1). The curved plaiter 7 is preferably of rectangular cross-section throughout its length and may be a square. The base of the plaiter is preferably mounted on a circular bearing 5 at the exit end of the fabric transport tube and preferably comprises a stainless steel spherical ball roller bearing 5 which is rotatably fixed to the end of the fabric transport tube. In this manner, the entire plaiting mechanism 7 may be oscillated rapidly about the centerline of the transport tube C. The plaiter 7 defines an outlet nozzle 15 which extends downwardly into fluid communicating relationship with the inlet to the liquid treatment chamber 10. As noted, the plaiting mechanism is mounted on a circular bearing 5 about which it may be oscillated in any known fashion through the reciprocating action of oscillation means 6. The plaiter may be oscillated at rates ranging from 10 to 50 complete strokes per minute and travels in a path which preferably defines a straight line across the complete width of the inlet to the liquid treatment chamber.

Also in accordance with the invention, the outlet nozzle 15 defined by the plaiter 7 is oriented approximately 90 degrees to the chamber centerline and is also substantially perpendicular to the longitudinal axis or centerline C of the fabric transport tube 11. If the tube 11 is substantially straight then the angle defined between the centerline C and the nozzle 15 will be around approximately 90 degrees. Since the centerline C of the transport tube 11 will vary in its geometry from a straight line, and particularly in accordance with the preferred embodiments, the exact angle may vary and it is only important that the outlet nozzle 15 is downwardly directed and reciprocates along a generally linear path of travel which is transverse to the centerline and such that the fabric material 1 passing through the transport tube 11 is deposited in the inlet of the liquid treatment chamber in overlying relatively straight folds. For example, where the shallow v-shaped profile of the transport tube is employed as illustrated, the angle defined between the second transport zone defining a portion of the centerline C and the outlet nozzle 15 will be less than about 90 degrees. In this manner, the path of travel of the nozzle 15 will be a straight line across the width of the storage chamber 10 in contrast to prior art devices.

The present invention also preferably includes a liquor bypass 8 in the plaiter assembly 7 which includes a bypass nozzle 9 which preferably communicates with the storage chamber through a path which is longitudinally spaced apart from the main path of travel of the fabric entering the storage chamber 10. In this manner, the water under pressure will tend to follow a straight line while the weight of the fabric facilitates its deflection into the liquid treatment chamber. This ensures that the liquor which is allowed to escape through the bypass nozzle 9 will not disturb the plaiting operation occurring within the treatment chamber 10. Thereafter, excess liquor in the chamber 10 is recirculated by the pump P to the header 12.

As noted above, this invention also relates to the resulting method of dyeing a length of textile material as described hereinabove which includes the steps of guiding a length of textile material through a generally horizontally directed transport tube while applying a jet of liquid dye onto the material in the tube to dye the fabric and advance it through the transport tube. The textile material is then advanced downwardly from the exit end of the transport tube and reciprocated along a linear path of travel transverse to the direction of advance through the transport tube so as to form overlying relatively straight folds of the material in the transport chamber.

As can be seen from the foregoing, a jet dyeing apparatus and method according to the present invention present many distinct advantages over prior devices and techniques of this general type. In the foregoing description and accompanying drawings, there have been disclosed typical preferred embodiments of the invention and, although specific terms are employed, they are used in a generic and descriptive sense only and not for purposes of limitation, the scope of the invention being set forth in the following claims.

I claim:

1. A jet dyeing apparatus for use in dyeing textile materials in rope form, and comprising a housing, a liquid treatment chamber positioned in the lower portion of said housing and having an upwardly open inlet and upwardly open outlet, a fabric transport tube positioned in said housing above said liquid treatment chamber and comprising an elongate tubular member which defines a generally horizontal centerline and which includes an entry and an exit end, at least one liquid application jet positioned along said fabric transport tube for applying pressurized liquid dye to the fabric in said tube so as to dye the fabric and advance the fabric therethrough, a plaiting member mounted to said exit end of said transport tube for relative rotation about said centerline of said transport tube and including a downwardly directed outlet nozzle which is generally rectangular in cross-section overlying the inlet of said liquid treatment chamber, and means for oscillating said plaiting member about said centerline of said transport tube such that said downwardly directed outlet nozzle reciprocates along a generally linear path of travel which is transverse to said centerline, and such that a fabric material passing through said fabric transport tube is deposited in said inlet of said liquid treatment chamber in overlying, relative straight folds.

2. The jet dyeing apparatus as defined in claim 1 wherein said fabric transport tube has a relatively shallow V-shaped outline when viewed in side elevation and so as to define a downwardly inclined first transport zone and an upwardly inclined second transport zone.

3. A jet dyeing apparatus according to claim 2 wherein said at least one textile dye application jet comprises a first jet positioned in said first transport zone and a second jet positioned in said second transport zone.

4. A jet dyeing apparatus according to claim 3 wherein one of said peripheral liquor sprayers is positioned adjacent the fabric inlet to the fabric transport tube and the second peripheral liquor sprayer is positioned in the second transport zone adjacent the intersection between the first transport zone and the second transport zone.

5. A jet dyeing apparatus as defined in claim 1 wherein said fabric outlet nozzle is rectangular in cross-section.

6. A jet dyeing apparatus as defined in claim 1 wherein said nozzle further comprises dye liquor bypass means for withdrawing a portion of the dye liquor flowing through the fabric transport tube before passing outwardly through said outlet end.

7. A jet dyeing apparatus according to claim 6 wherein said dye liquor bypass means comprises a perforated insert in fluid communicating relation with said outlet nozzle.

8. A method of dyeing a length of textile material which is in rope form, and comprising the steps of guiding a length of textile material through a generally horizontally directed transport tube, while applying at least one jet of liquid dye onto the textile material in said transport tube so as to dye the fabric and advance the same therethrough, while directing the advancing textile material downwardly from the exit end of said transport tube and into a liquid treatment chamber, and including reciprocating the advancing textile material along a linear path of travel which is transverse to the direction of advance through the transport tube and so as to form overlying, relatively straight folds of the textile material in said treatment chamber.

9. The method as defined in claim 8 comprising the further step of returning the textile material from said liquid treatment chamber to the entry end of said transport tube so as to repeatedly process the textile material.

* * * * *